US005511731A

United States Patent [19]

Schmidt

[11] Patent Number: 5,511,731

[45] Date of Patent: Apr. 30, 1996

[54] SCREEN CONSTRUCTION FOR FLOUR MILLS

[76] Inventor: Arnold Schmidt, Box 99, Maple Creek, Saskatchewan, Canada, S0N 1N0

[21] Appl. No.: 202,813

[22] Filed: Feb. 28, 1994

[30] Foreign Application Priority Data

Mar. 18, 1993 [CA] Canada ..... 2091954

[51] Int. Cl.[6] ..... B02C 13/284

[52] U.S. Cl. ..... 241/74; 241/86; 241/188.1

[58] Field of Search ..... 241/74, 86, 188.1, 241/189.1

[56] References Cited

U.S. PATENT DOCUMENTS

| | | | |
|---|---|---|---|
| 979,063 | 12/1910 | Edwards . | |
| 1,157,095 | 10/1915 | Frick . | |
| 1,494,302 | 5/1924 | Borton . | |
| 1,634,026 | 6/1927 | Fritz | 241/74 |
| 1,706,254 | 3/1929 | Rees | 241/74 |
| 1,861,471 | 6/1932 | Frickey . | |
| 2,098,480 | 11/1937 | Ammon . | |
| 2,291,815 | 8/1942 | Korum . | |
| 2,545,159 | 3/1951 | McGihon | 241/86 |
| 2,557,865 | 6/1951 | Emmanuilidis | 241/74 |
| 2,573,048 | 10/1951 | Newkirk et al. | 241/86 X |
| 2,722,386 | 11/1955 | Fraser . | |
| 3,169,711 | 2/1965 | Helms | 241/74 |
| 4,228,964 | 10/1980 | Brady . | |
| 4,347,986 | 9/1982 | Haddon | 241/74 |
| 4,458,845 | 7/1984 | Marcalus | 241/74 X |

FOREIGN PATENT DOCUMENTS

| | | | |
|---|---|---|---|
| 1222234 | 5/1987 | Canada . | |
| 657808 | 3/1938 | Germany | 241/74 |
| 603559 | 4/1960 | Italy | 241/74 |
| 1036609 | 7/1966 | United Kingdom | 241/74 |

*Primary Examiner*—Timothy V. Eley

*Attorney, Agent, or Firm*—Murray E. Thrift; Adrian D. Battison

[57] ABSTRACT

A rotary mill, particularly designed for the milling of flour, includes a screen assembly within which the hammer assembly rotates. It consists of a fine inner cylindrical screen surrounded by a coarse support screen. The cylindrical end edges of the screens are supported in end channels. The intake end of the cylindrical screen is provided with an annular wear plate around the inside thereof and extending two or three inches inwardly to protect the fine screen against heavy wear as the whole grain is entering and beginning to be broken up by the hammer assembly. A lip projects inwardly from the free edge of the wear strip to restrain movement of large particles onto the screen.

8 Claims, 2 Drawing Sheets

SCREEN CONSTRUCTION FOR FLOUR MILLS

FIELD OF THE INVENTION

The present invention relates to improvements in a screen assembly for rotary mills used in the milling of flour.

BACKGROUND

Conventional milling methods, particularly when used on whole grains, do not mill the husks, which are fibrous, to the same fine consistency as the white or inner kernel. Consequently, relatively large brown specks are always present in whole wheat flours. This affects not only the appearance of the flour but also the leavening of the flour due to the difference in size of the particles and the fact that the bran tends to absorb moisture unevenly.

In my earlier Canadian patent No. 1,222,234, I describe the milling of whole wheat flour by means of a rotary mill. Using this technique, the husk and the kernel are milled to the same particle size. This is accomplished through the use of a relatively fine screen surrounding rotary mill rotor which retains the bran component in the mill until it is the desired small particle size and can pass through the screen.

It has been found that the relatively fine screen used suffers considerable wear because of the action of the rotary mill and must be replaced frequently. Especially heavy wear has been found at the inlet of the screen.

The present invention is intended to ameliorate this rapid wear of the screen.

SUMMARY

According to one aspect of the present invention there is provided a screen assembly for rotary mills used particularly in the milling of grain to flour, said screen assembly comprising:

an inner screen comprising a cylinder of relatively fine mesh and having first and second ends;

an outer screen comprising a cylinder of relatively coarse mesh surrounding the inner screen in supporting engagement therewith, the outer screen having first and second ends adjacent the first and second ends respectively of the inner screen;

first screen support means supporting the first ends of the inner and outer screens; and second screen support means supporting the second ends of the inner and outer screens.

A screen with a mesh fine enough to pass only flour size particles is inherently thin, flexible and prone to rapid wear by abrasion. It has been ascertained that if the flexibility can be reduced, the wear is also significantly reduced. The outer screen, being of a coarser mesh than the inner screen is rigid and gives support to the inner screen without inhibiting the passage through it of the ground flour.

According to another aspect, the invention provides a rotary mill including a screen assembly of the above type.

According to a further aspect of the present invention there is provided a rotary mill particularly for the milling of grain to flour, comprising:

a pair of end walls including an inlet end wall;

grain inlet means through the inlet end wall;

a cylindrical screen assembly extending between the end walls;

screen support means supporting the screen assembly on the respective end walls; and annular wear strip means positioned inside the screen assembly and extending part way along the inner surface of the screen assembly from the inlet end wall.

The wear strip prevents excessive wear at the inlet end of the screen assembly, while is believed to be caused by the abrading action of the large grain particles in this area.

In preferred embodiments, the wear strip has a lip on its free edge, projecting centrally to restrain the larger grain particles against movement off the strip onto the screen.

BRIEF DESCRIPTION OF THE DRAWINGS

In the accompanying drawings, which illustrate an exemplary embodiment of the present invention.

DETAILED DESCRIPTION

Figure 1:
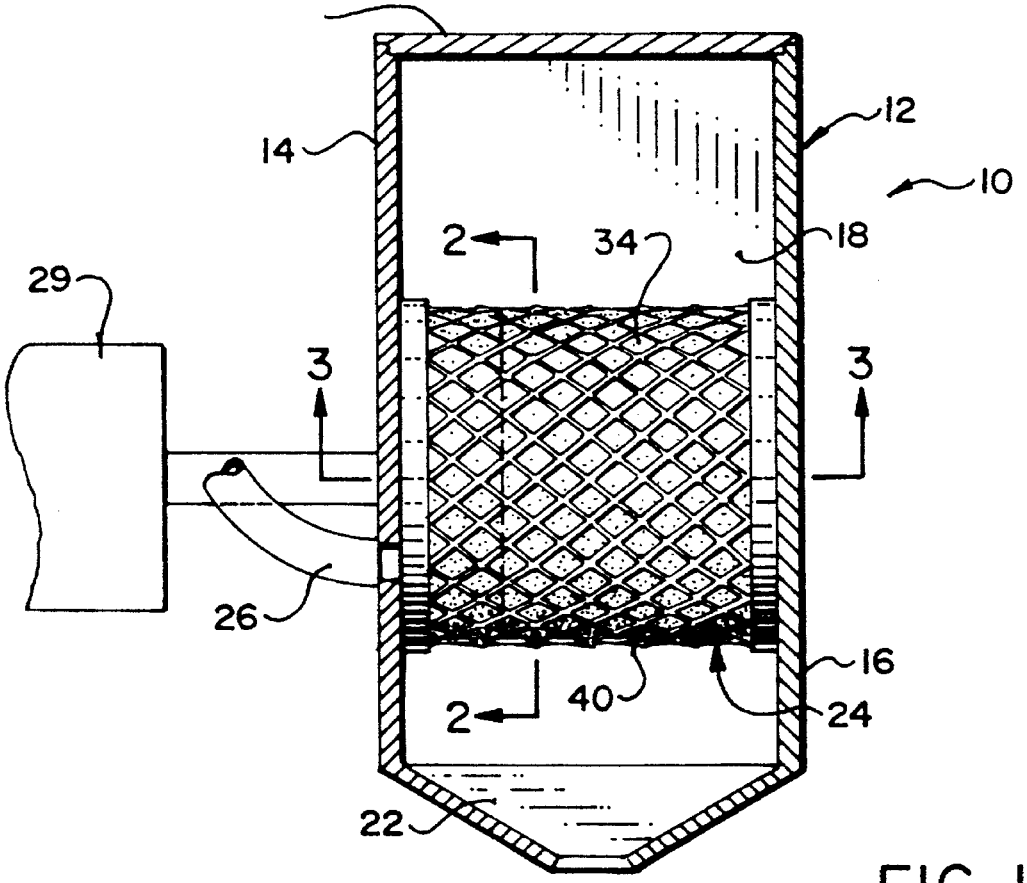
FIG. 1 is a side elevation, partially in section of the hammer mill.
Figure 2:
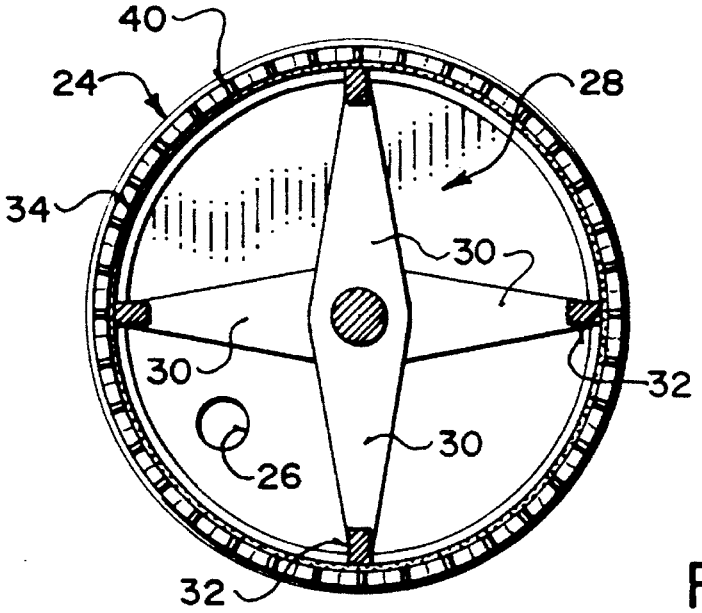
FIG. 2 is a view along line 2—2 of FIG. 1.
Figure 3:
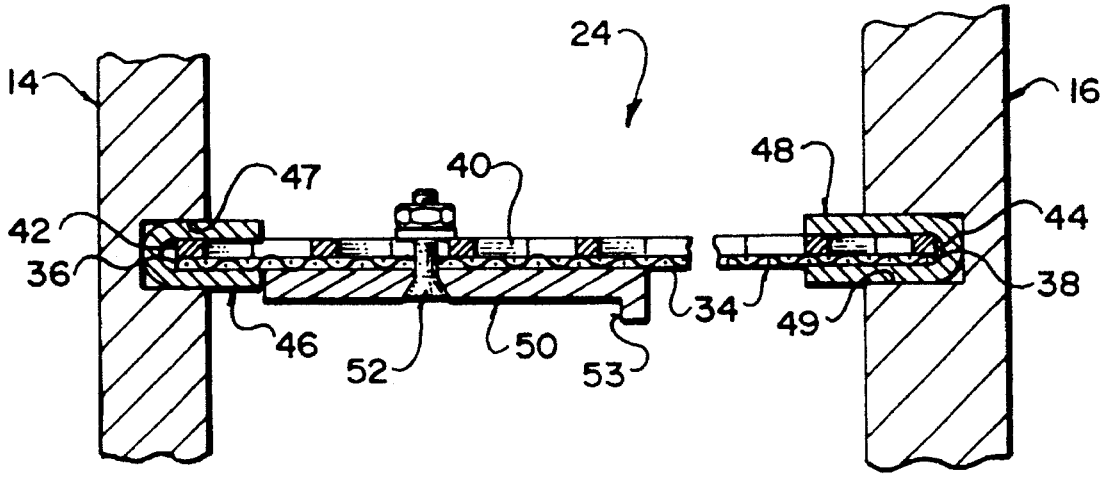
FIG. 3 is a view along line 3—3 of FIG. 1.

Referring to the accompanying drawings, FIG. 1 illustrates a rotary mill 10 that includes a housing 12 with opposed end walls 14 and 16, two side walls, one of which is illustrated at 18, a top wall 20 and an hopper type bottom 22. Extending across the interior of the housing, between the end walls 14 and 16 is a cylindrical screen assembly 24. An inlet 26 extends through the end wall 14 to supply grain to the interior of the screen assembly. Concentrically within the screen assembly is a rotary mill rotor 28. This is driven by a motor 29. The rotor consists of a series of radial arms 30 carrying respective heads 32 for milling grain introduced into the screen assembly through the inlet 26.

The screen assembly 24 includes an inner cylindrical screen 34 with an inlet end 36 and an opposite second end 38. Surrounding the inner screen and supporting it against deflection out of its cylindrical shape is an outer screen 40 of expanded metal mesh. The outer screen has an inlet end 42 coinciding with the inlet end 36 of the inner screen and a second end 44 coinciding with the end 38 of the inner screen. The mesh of the inner screen is sufficiently fine that it will retain within the screen assembly all particles larger than that desired in the flour being milled. This is therefore, a very fine mesh. The outer screen, on the other hand, has a very large mesh, for example over 1" in opening size so that it does not restrict the passage of flour through the inner screen but provides considerable support to the inner screen against deformation.

The inner and outer screens are connected at their ends by respective annular channels 46 and 48. The channel 46 extends over the inlet ends 36 and 42 of the two screens and is seated in a slot 47 in the end wall 14 of the housing. Channel 48 likewise extends over the ends 38 and 44 of the two screens and is seated in a slot 49 in the end wall 16.

The channels 46 and 48 provide an effective mechanism for quickly and easily replacing a worn inner screen. The channels may be removed, the inner screen slid out of the outer screen and replaced, and then the channels replaced to hold the screens together as a unit.

Adjacent the channel 46 is an annular wear strip 50 that extends along the inside surface of the inner screen 34 from the channel 46. The wear strip is secured to the screens by flathead bolts 52 with suitable nuts. Along the free edge of the wear strip is a lip 53 projecting centrally from the strip.

Figure 4:
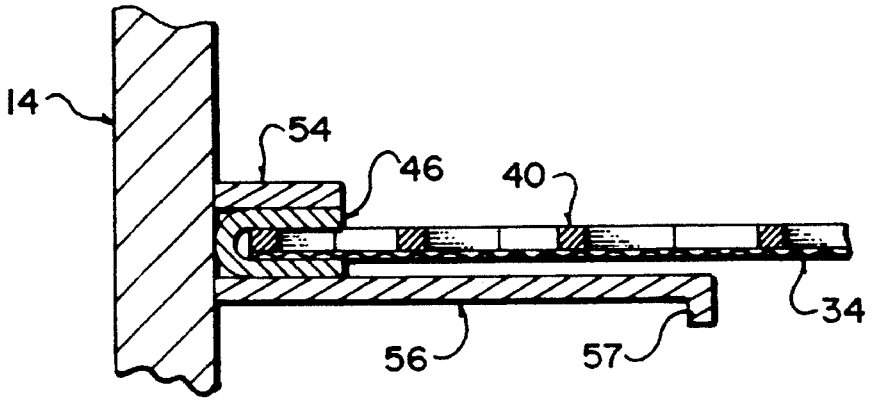
FIG. 4 is a view like FIG. 3 showing an alternative embodiment of the inlet and screen support.

An alternative embodiment of the screen support is illustrated in FIG. 4, where the channel 46 is captive between two flanges 54 and 56. The inner flange is substantially longer than the outer flange and serves as the wear strip in this embodiment and carries the restraining lip 57. The two flanges are secured to the end wall 14.

Figure 5:
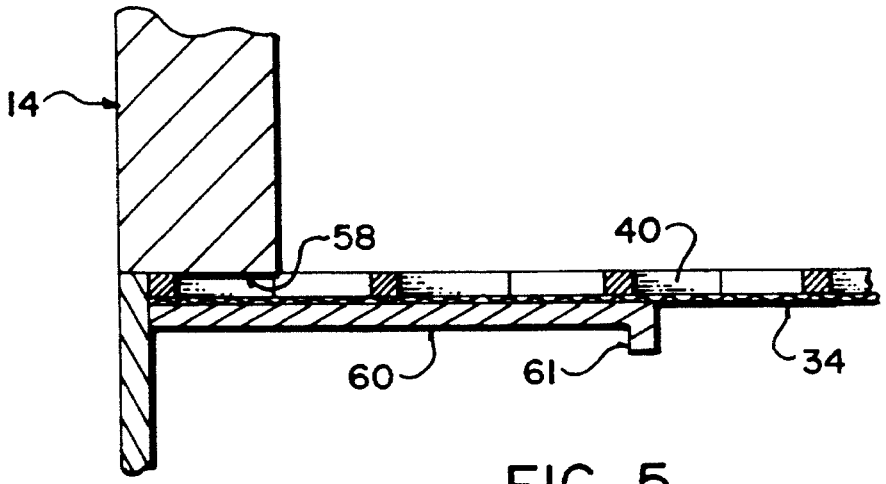
FIG. 5 is a view like FIG. 3 showing a further embodiment of the inlet end screen support.

FIG. 5 illustrates a further embodiment of the screen support, where the screen ends are seated in an annular slot 58 in the end wall 14. The wear strip 60 is secured to the end wall on the inside of the screen assembly and extends along the inner face of the inner screen 34. Lip 61 projects centrally from the wear strip.

In use of the invention, grain is introduced through the inlet 26 and the rotor 28 is driven to mill the grain to flour. Adjacent the inlet where the grain is introduced to the inside of the screen assembly 24, the wear strip and its associated lip prevent the still relatively large particles of grain from abrading away the fine inner screen material. The rigid outer screen 40 prevents the flexible inner screen from deforming due to the milling action being carried out inside the screen assembly and provides a substantial increase in the service life of the inner screen.

The milled flour passes through the inner and outer screens and is collected in the hopper bottom 22 of the housing 12.

Although the present invention was designed for milling whole wheat flour, white flour of a high quality can be obtained by using conventional sifting and purifying techniques on the flour after milling. It is also possible to de-bran the flour before milling.

While certain embodiments of the present invention have been described in the foregoing, it is to be understood that other embodiments are possible within the scope of the invention. The scope of the invention is to be ascertain solely by reference to the appended claims.

I claim:

1. A rotary mill for milling grain into flour, comprising:

a first end wall;

an inlet in the first end wall;

a closed second end wall opposed to the first end wall;

a substantially horizontal cylindrical screen having first and second ends;

first and second screen support means securing the first and second ends of the screen assembly to the first and second end walls, with the screen surrounding the inlet;

a milling rotor rotatable on a horizontal axis and extending centrally through the screen; and a cylindrical within the screen and extending along the screen from the first end thereof, the wear strip comprising part of the first screen support means.

2. A screen assembly for rotary mills used particularly in the milling of grain into flour, said screen assembly comprising;

an inner screen comprising a cylinder of relatively fine mesh having first and second ends;

an outer screen comprising a cylinder of relatively coarse mesh surrounding the inner screen in supporting engagement therewith, the outer screen having first and second ends adjacent the first and second ends respectively of the inner screen;

first screen support means for supporting the first ends of the inner and outer screens;

second screen support means supporting the second ends of the inner and outer screens;

an inlet into the screen assembly adjacent the first ends of the screens; and a cylindrical wear strip within the screen assembly which extends partially along the inner screen from the first end thereof, the wear strip comprising part of the first screen support means.

3. A screen assembly for rotary mills used particularly in the milling of grain into flour, said screen assembly comprising:

an inner screen comprising a cylinder of relatively fine mesh having first and second ends;

an outer screen comprising a cylinder of relatively coarse mesh surrounding the inner screen in supporting engagement therewith, the outer screen having first and second ends adjacent the first and second ends respectively of the inner screen;

first screen support means for supporting the first ends of the inner and outer screens;

second screen support means supporting the second ends of the inner and outer screens;

a cylindrical wear strip within the screen assembly which extends partially along the inner screen from the first end thereof; and a lip projecting inwardly from the wear strip at a position spaced from the first end of the inner screen.

4. A rotary mill for milling grain into flour, including a rotor carrying a plurality of milling heads, a screen assembly surrounding the rotor and an inlet for grain at one end of the screen assembly, wherein the screen assembly comprises:

an inner screen comprising a cylinder of relatively fine mesh having a first end adjacent the inlet into the screen assembly and a second end;

an outer screen comprising a cylinder of relatively coarse mesh surrounding the inner screen in supporting engagement therewith, the outer screen having first and second ends adjacent the first and second ends respectively of the inner screen;

first screen support means for supporting the first ends of the inner and outer screens;

second screen support means supporting the second ends of the inner and outer screens;

a cylindrical wear strip within the screen assembly which extends along the inner screen from the first end thereof; and a lip projecting inwardly from the wear strip at a position spaced from the first end of the inner screen.

5. A rotary mill particularly for the milling of grain to flour, comprising;

a pair of end walls including an inlet end wall and an opposite closed end wall;

grain inlet means through the inlet end wall;

a cylindrical screen assembly extending between the end walls;

screen support means including two annular channels carried by respective ones of the end walls and supporting the screen assembly on the respective end walls; and an annular metal wear strip comprising an integral extension of the channel carried by the inlet end wall, positioned inside the screen assembly and extending part way along the inner surface of the screen assembly from the inlet end wall.

6. A rotary mill according to claim 5 including a lip projecting inwardly from the wear strip at a position spaced from the inlet end wall.

7. A rotary mill particularly for the milling of grain to flour, comprising:

a pair of end walls including an inlet end wall;

grain inlet means through the inlet end wall;

a cylindrical screen assembly extending between the end walls;

screen support means supporting the screen assembly on the respective end walls;

annular wear strip means positioned inside the screen assembly and extending part way along the inner surface of the screen assembly from the inlet end wall; and a lip projecting inwardly from the wear strip at a position spaced from the inlet end wall.

8. A rotary mill particularly for the milling of grain to flour, comprising:

a pair of end walls including an inlet end wall and an opposite closed end wall;

grain inlet means through the inlet end wall;

a cylindrical screen assembly extending between the end walls;

screen support means supporting the screen assembly on the respective end walls;

annular wear strip means positioned inside the screen assembly and extending part way along the inner surface of the screen assembly from the inlet end wall; and a lip projecting inwardly from the wear strip at a position spaced from the inlet end wall.

* * * * *